United States Patent [19]

Spain

[11] Patent Number: 4,885,973

[45] Date of Patent: Dec. 12, 1989

[54] METHOD OF MAKING COMPOSITE ARTICLES

[75] Inventor: Raymond G. Spain, Farmington Hills, Mich.

[73] Assignee: Airfoil Textron Inc., Lima, Ohio

[21] Appl. No.: 284,336

[22] Filed: Dec. 14, 1988

[51] Int. Cl.[4] ..... D04C 1/02; D04C 1/06; B32B 31/00

[52] U.S. Cl. ..... 87/1; 28/170; 87/5; 87/7; 87/8; 87/28; 87/30; 87/33; 156/148; 156/155

[58] Field of Search ..... 87/1, 5–9, 87/11, 28, 30, 33, 34, 23; 139/11, 13 R, 16; 156/148, 149, 155; 28/168, 170

[56] References Cited

U.S. PATENT DOCUMENTS

| | | | |
|---|---|---|---|
| 3,426,804 | 2/1969 | Bluck | 139/11 |
| 3,966,522 | 6/1976 | Hatch et al. | 156/148 |
| 4,312,261 | 1/1982 | Florentine | 87/33 |
| 4,519,290 | 5/1985 | Inman et al. | 87/7 |
| 4,719,837 | 1/1988 | McConnell et al. | 87/1 |
| 4,753,150 | 6/1988 | Brown | 87/33 |

*Primary Examiner*—John Petrakes
*Attorney, Agent, or Firm*—Edward J. Timmer

[57] ABSTRACT

A composite article is made by braiding a 3D article shaped preform including non-fugative braider reinforcing fibers and fugative fibers and removing the fugative fibers to form a plurality of matrix-ingress passages in the braided preform. During impregnation of the braided preform with a matrix material, matrix material is supplied to the interior of the preform via the passages. The fugative fibers typically comprise fugative monofilaments which are substantially larger in size than the non-fugative fibers to permit one or more dimensions of the preform and thus the composite article to be increased beyond the capacity of the particular braiding apparatus employed.

20 Claims, 3 Drawing Sheets

METHOD OF MAKING COMPOSITE ARTICLES

FIELD OF THE INVENTION

The invention relates to a method of braiding articles using fugative fibers as braider fiber elements and/or axial stuffer fiber elements.

Background Of The Invention

Three-dimensional (3D) braiding is a known process for forming fiber preforms by continuous intertwining of fibers or filaments. During the 3D braiding process, a plurality of fiber carriers in a matrix array are moved across a carrier surface. A fiber extends from each carrier member and is intertwined with fibers from other carrier members as they are concurrently moved. The fibers are gathered above the carrier surface by suitable means. The 3D braiding process is characterized by an absence of planes of delamination in the preform and results in a tough, crack growth resistant composite article when the preform is disposed in a matrix such as plastic, carbon, metal or other known matrix material. The Bluck U.S. Pat. No. 3,426,804 issued Feb. 11, 1969, and the Florentine U.S. Pat. No. 4,312,761 issued Jan. 26, 1982, illustrate apparatus for braiding a 3D article preform using fiber carriers in a rectangular, row-column matrix or circular, concentric-ring matrix.

Copending U.S. patent application Ser. No. 191,564 of common assignee herewith illustrates a 3D braiding apparatus wherein the braiding fibers carried on the fiber carriers are braided about a plurality of so-called axial stuffer fibers extending from the carrier surface. Axial stuffer fibers are provided in the braided preform to provide directional strength properties in the composite article that results from impregnation of the preform with a matrix material.

It is an object of the invention to provide a method of making a composite article wherein bending or deformation of the axial stuffer fibers by the braider fibers during the braiding operation is reduced.

It is another object of the invention to provide a method of making a composite article wherein the spacing between the braider fibers and/or axial stuffer fibers of the braided preform is controllably increased to expand one or more dimensions of the braided preform and vary the shape of the braided preform.

It is a further object of the invention to provide a method of making a composite article wherein the preform is braided using fugative braider and/or fugative axial stuffer fibers which are removed prior to impregnation of the preform with matrix material to form a plurality of matrix-ingress passages in the preform to facilitate impregnation thereof with a matrix material.

SUMMARY OF THE INVENTION

The invention contemplates a method of making a composite article including (a) forming a braided preform including a plurality of non-fugative braider fibers and a plurality of fugative fibers, (b) selectively removing the fugative fibers from the preform to form a plurality of elongate matrix-ingress passages in the preform and (c) impregnating the preform with a matrix material, including supplying the matrix material through the matrix-ingress passages to facilitate impregnation.

In one embodiment of the invention, the fugative fibers constitute braider fibers and/or axial stuffer fibers. Preferably, the fugative fibers comprise fugative monofilaments having a cross-sectional size (e.g., diameter) up to 120 times that of the individual non-fugative fibers.

In another embodiment of the invention, the fugative fibers are removed from the preform prior to the impregnation step by mechanically pulling them out of the preform. The fugative fibers can also be removed by selective disintegration, such as thermal oxidation of the fugative fibers.

In still another embodiment of the invention, the preform is impregnated with a resin solution that is introduced into the interior of the preform via the matrix-ingress passages.

The invention also contemplates a method of making a composite article including (a) intertwining a plurality of non-fugative braider fibers and a plurality of fugative braider monofilaments and/or fugative axial stuffer monofilaments to form a braided preform, (b) removing the fugative monofilaments and (c) impregnating the preform with a matrix material.

The size and position of the fugative monofilaments can be selected to increase the spacing of the non-fugative fibers and expand one or more dimensions (e.g., the thickness and width) of the preform. The cross-sectional shape of the preform can be changed by appropriately sizing and positioning the fugative monofilaments.

The fugative axial stuffer monofilaments can be used with non-fugative axial stuffer fibers to reduce bending or deformation of the latter when the non-fugative braider fibers are braided thereabout.

DETAILED DESCRIPTION OF THE INVENTION

Figure 1:
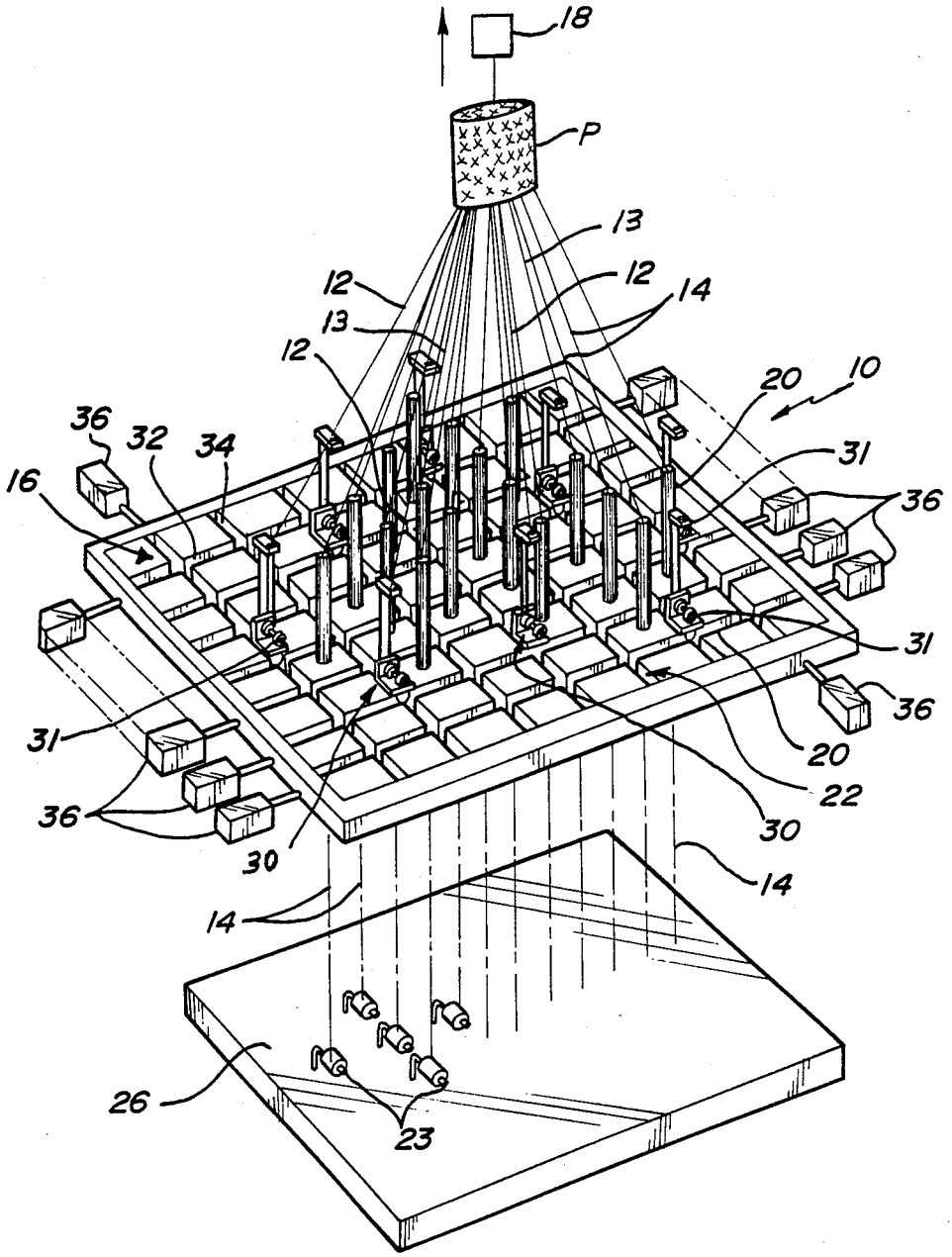
FIG. 1 is a schematic perspective view of a braiding apparatus for practicing one embodiment of the method of the invention.
Figure 2:
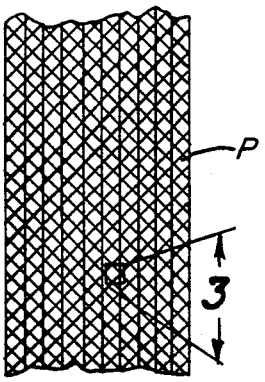
FIG. 2 is a partial side elevation of a braided preform with the fugative fibers in the braider positions.

The method of the invention can be practiced on a braiding device 10 such as that schematically shown in FIG. wherein non-fugative (permanent) braider fiber bundles or yarns 12, fugative (removable) braider fiber bundles or yarns 13 and non-fugative axial stuffer fiber bundles or yarns 14 extend from a braiding surface 16 toward a puller or take-up mechanism 18 located above the braiding surface 16. The braider fiber bundles 12,13 are moved in a braiding pattern across the braiding surface 16 to intertwine or interlace with one another and with the axial stuffer fiber bundles 14 which either remain in fixed position, FIG. 1, on the braiding surface 16 or are moved in opposite parallel directions thereon while the braiding fiber bundles 12 are moved in the desired braiding pattern as explained in copending application Ser. No. 191,564 of common assignee herewith, the teachings of which are incorporated herein by reference.

The braiding apparatus 10 of FIG. 1 includes a plurality of axial stuffer fiber guide tubes 20 and an X–Y grid support 22. A non-fugative axial stuffer fiber bundle 14 is fed to each guide tube 20 from a spool or supply 23 disposed on a lower support (creel) 26 located beneath the grid support 22.

A plurality of braider fiber carriers 30 are disposed in grooves 32,34 of the grid support 22 for movement in the X and Y directions by means of actuators 36 (shown schematically) such as fluid cylinders, solenoids and the like. The carriers 30 are moved by the actuators 36 in a braiding pattern to interlace the braider fiber bundles 12,13 with one another and with the fixed axial stuffer fiber bundles 14 to form a 3D braided preform P which is moved away from the braiding surface 16 by the puller or take-off mechanism 18. Each braiding fiber bundle 12, 13 is dispensed from a spool or supply 31 on each carrier 30. The 3D braided preform P is illustrated as having an untwisted airfoil shape but myriad other preform shapes can be braided in accordance with the method of the invention. The carriers 30 can be moved in various braiding patterns to this end as taught in the Bluck U.S. Pat. No. 3,426,804 and the McConnel and Popper U.S. Pat. No. 4,719,837, as those skilled in the art will appreciate. Only some actuators 36 are shown in FIG. 1 for convenience. Those skilled in the art will appreciate that an actuator 36 is associated with each row and column of the grid support 22 at opposite ends of each row and column.

A preferred braiding apparatus for practicing the method of the invention is described in copending U.S. patent application Ser. No. 191,434 and 191,564 of common assignee herewith, the teachings of which are incorporated herein by reference.

In a first exemplary embodiment of the invention, the non-fugative braider fiber bundles 12 and the non-fugative axial stuffer fiber bundles 14 each comprises a single strand (yarn) of 12,000 filament Celion G30-500 reinforcing carbon fibers available from BASF Structural Materials, Inc. The fugative braider fiber bundles, and 13 each comprises a fugative monofilament of relatively large diameter, such as nylon or polypropylene, which is removable from the braided preform P as will be explained hereinbelow.

The fugative monofilament 24 typically will have a diameter (or other cross-sectional dimension) in the range of about 7 to about 40 mils. Preferably, the fugative monofilaments will have a diameter of about 10 to about 15 mils. The diameter of the fugative monofilaments is selected to be relatively large compared to the diameter of the non-fugative fibers 12,14 for reasons to be explained hereinbelow. The diameter of the non-fugative fiber bundles 12,14 typically is in the range of about 0.02 inch to about 0.05 inch.

Figure 3:
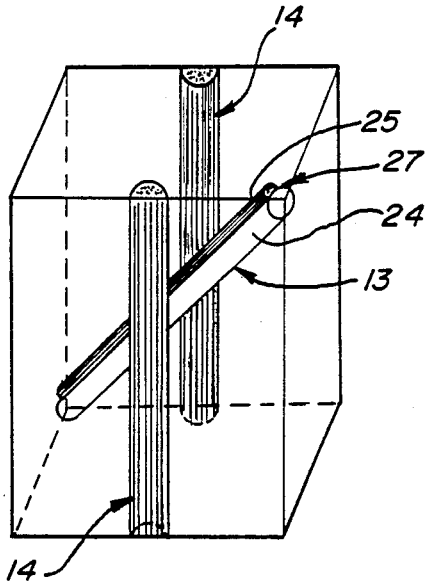
FIG. 3 is an enlarged perspective view of the boxed-in area of FIG. 2 showing the non-fugative and fugative fibers.
Figure 5:
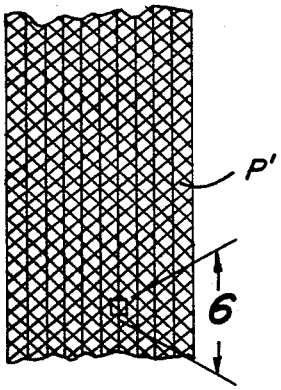
FIG. 5 is a partial side elevation of another braided preform with the fugative fibers in axial stuffer positions.

The fugative braider monofilaments 24 may optionally be disposed with non-fugative reinforcing fibers 25 (e.g., reinforcing carbon fibers) in a fiber bundle 27, FIG. 3. The non-fugative fibers 25 can be twisted about the fugative monofilament or laid side-by-side therewith to form the fiber bundle.

The fiber bundles or yarns 12, 13 and 14 described hereinabove are arranged on the braiding apparatus 10 to extend away from the braiding surface 16, as shown in FIG. 1, and then the fiber bundles 12,13 are moved in a selected braiding pattern to intertwine the braider fiber bundles 12,13 with one another and with the axial stuffer fiber bundles 14 to form the braided preform P. The braided preform P includes the stuffer fiber bundles 14 extending axially or longitudinally through the braided pattern of the braider fiber bundles 12,13.

Figure 4:
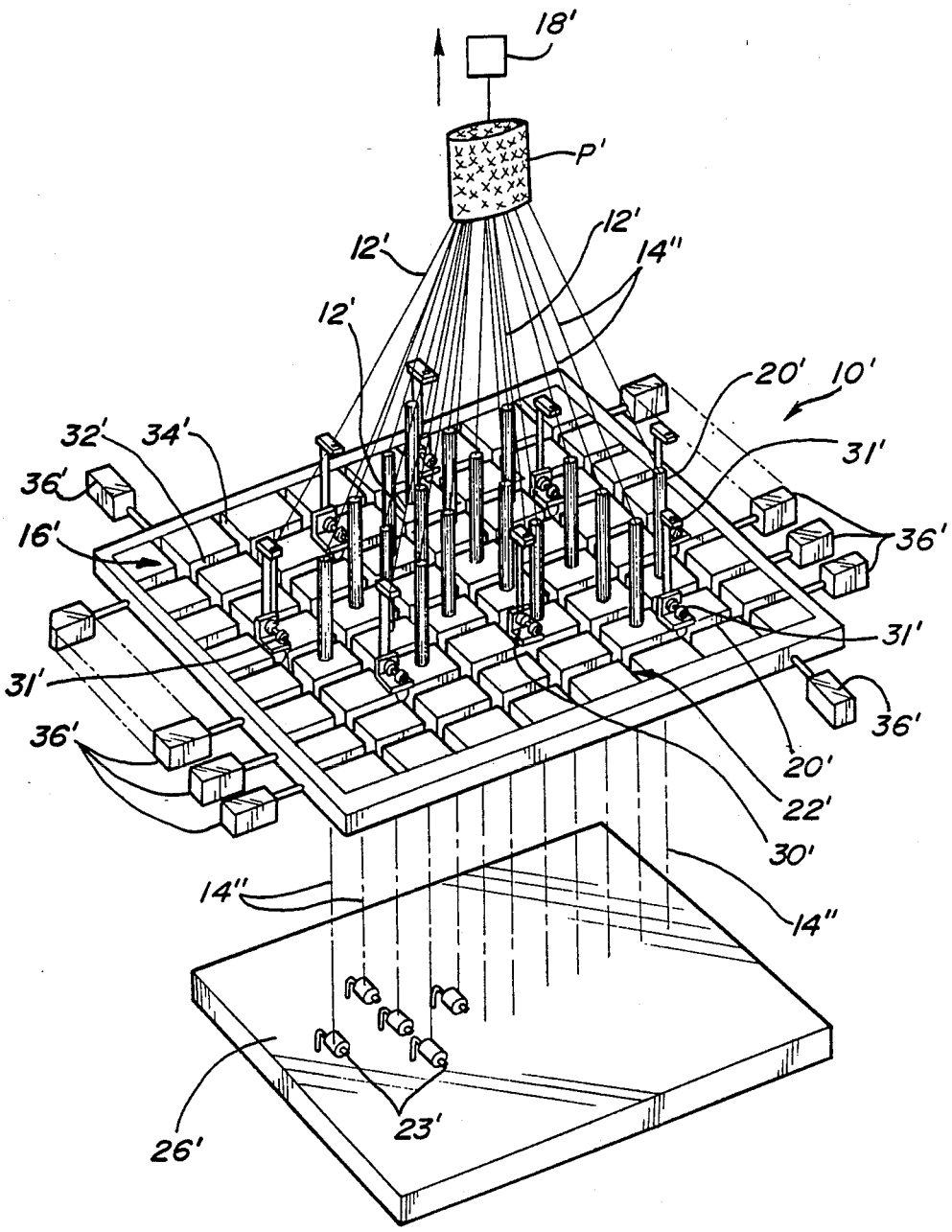
FIG. 4 is a schematic perspective view of a braiding apparatus for practicing another embodiment of the invention.

Referring to FIG. 4, a second exemplary embodiment of the method of the invention can be practiced on the braiding apparatus 10' wherein like features of the apparatus of FIG. 1 bear like reference numerals primed and wherein non-fugative (permanent) braider fiber bundles 12' and fugative (removable) axial stuffer fibers or bundles 14'' extend from the braiding surface 16'. The non-fugative braider fiber bundles 12' each comprises a single strand of 12K (12,000 filament) Celion reinforcing carbon fibers while the fugative axial stuffer fibers or bundles 14'' each comprises a fugative monofilament 24' (e.g., nylon or polypropylene) as described above with or without associated non-fugative reinforcing fibers 25', (e.g., reinforcing carbon fibers) FIG. 6.

Figure 6:
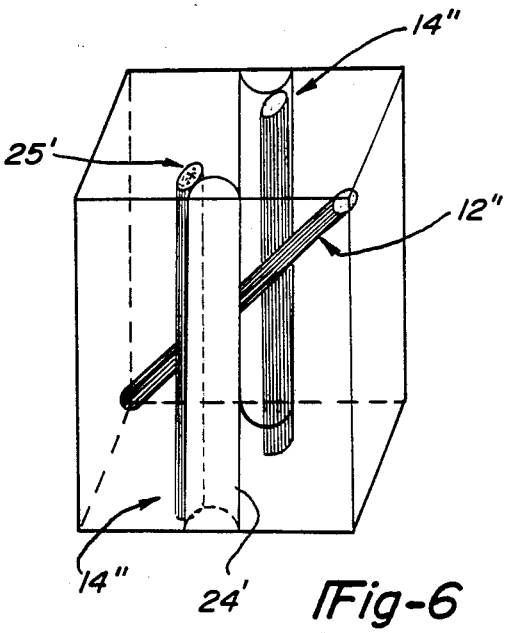
FIG. 6 is an enlarged perspective view of the boxed-in area of FIG. 5 showing the non-fugative and fugative fibers.

In this embodiment of the invention, the non-fugative braider fiber bundles 12' are moved in a selected braiding pattern to intertwine the bundles 12' with one another and with the fugative axial stuffer fibers or bundles 14'' to form the braided preform P' having the axial stuffer fiber bundles extending axially through the braided pattern of bundles 12', FIG. 6.

The braid preforms P,P' formed by the first and second exemplary embodiments are then subjected to a fugative fiber removal step to remove the respective fugative braider monofilaments 24 (FIG. 3) or fugative axial stuffer monofilaments 24' (FIG. 6) to form a plurality of elongate matrix-ingress passages 29,29' in the preforms P,P', respectively.

Removal of the fugative monofilaments 24,24' can be effected by physically pulling the fugative monofilaments 24,24' out of the respective preforms P,P'. Typically, the fugative monofilaments 24,24' are gripped at one end of the preform by a device with compressive jaws and simply pulled out by an adequate force applied to the device.

In an alternative version, the fugative monofilaments 24,24' are removed by preferential or selective thermal oxidation thereof by heating the preforms P,P' in an oxidizing atmosphere (e.g., air) to a temperature that will oxidize (burn out) the fugative monofilaments without substantially harming or destroying the non-fugative fiber bundles 12,12' in the preform.

Figure 7:
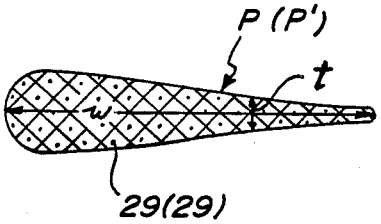
FIG. 7 is a cross-sectional view of the braided preform showing matrix-ingress passages formed therein upon removal of the fugative fibers.

Regardless of the means employed to remove the fugative monofilaments 24,24' , the resulting braided preforms P,P' will have a plurality of matrix-ingress passages 29,29', FIG. 7, formed therein corresponding to the previous positions of the fugative monofilaments 24,24' therein. In the first embodiment, the matrix-ingress passages 29 will assume the braided pattern of the fugative braider monofilaments 24. In the second embodiment, the matrix-ingress passages 29, will assume the axially or longitudinally extending pattern of the fugative axial stuffer monofilaments 24'.

Once the fugative monofilaments 24,24' are removed from the preforms P,P', the preforms are infiltrated with a matrix material and cured and/or heated to form a composite article. Exemplary matrix materials comprise epoxy or other resins, ceramics, metals and the like. Resin matrix materials (e.g., phenolic resins) are placed in a solution (e.g., isopropyl alcohol) and the preforms are impregnated with the solution using known vacuum impregnating procedures wherein the preform is subjected to repeated vacuum and pressure cycles in the presence of the resin solution. The matrix-ingress passages 29,29' greatly facilitate impregnation of the preforms since the resin solution can be supplied through the passages 29,29' to the interior of the preform. Ceramic/metal matrix materials can be infiltrated into the preform using chemical vapor deposition and other available techniques. Normally, the braided preforms are tightly braided and it can be difficult to impregnate the tightly braided structure using liquids or gases. The matrix-ingress passages 29,29' provide ready access of a fluid matrix material to the interior of the preform and permit fluid matrix material and/or gaseous material to be supplied and impregnated into the interior of the preform. Fluid matrix materials including solid particles disposed therein can be supplied to the interior of the preform through passages 29,29'.

The use of the fugative monofilaments 24, 24' in the braider fiber bundles 12 (FIG. 3) and in the axial stuffer fiber bundles 14'' (FIG. 6) in the braiding of the preforms offers several advantages. Due to their relatively large size (e.g., diameter), the fugative monofilaments can be used to expand one or more dimensions of the preform beyond that which is theoretically possible with a particular size of braiding apparatus 10 (10'). For example, use of the fugative monofilaments in the braider fiber bundles increases the spacing between the non-fugative braider fiber bundles (e.g., 12,12') and/or non-fugative axial stuffer fiber bundles (e.g., 14'') to increase the width w and thickness t of the preform P,P' beyond the possible with a particular size of braiding apparatus. It is thus possible to braid larger preforms than normally possible on the braiding apparatus without having to enlarge the apparatus itself.

Moreover, the size and location of the fugative monofilaments can be selected to locally change the shape or cross-section of the preform without having to modify the shape of the braiding apparatus.

As a result of their larger size (e.g., diameter), the fugative monofilaments 24,24' tend to impart a rigidizing effect to the preform enabling the braided shape to be more readily handled prior to removal of the fugative monofilaments.

In addition, in the second embodiment of the invention described hereinabove and shown in FIG. 6, the use of the fugative monofilaments 24' in the axial stuffer fiber bundles 14'' prevents bending, collapsing and distortion of the non-fugative axial stuffer fibers 25' as the non-fugative braider fiber bundles 12' are braided thereabout on the braiding apparatus 10' Since bending or other distortion of the non-fugative axial stuffer fiber 25' reduces their strength, a reduction in such bending or other distortion is beneficial to the properties of the preform and resultant composite article formed by impregnation of the preform with the matrix material.

Those skilled in the art will appreciate that the fugative monofilaments can be used in braider fiber bundles, in axial stuffer fiber bundles and in both braider and axial stuffer fiber bundles. Each braider fiber bundle or axial stuffer fiber bundle may include one or more monofilaments with or without non-fugative reinforcing fibers. They will also appreciate that the types of non-fugative fibers useful with the fugative fibers are not limited to those described hereinabove, which are offered merely for illustrative purposes.

While the invention has been described in terms of specific detailed embodiments thereof, the invention is not intended to be limited thereto but rather only to the extent set forth hereafter in the following claims.

I claim:

1. A method of making a composite article, comprising:

(a) forming a braided preform including a plurality of non-fugative braider fibers and a plurality of fugative fibers, (b) selectively removing the fugative fibers from the braided preform to form a plurality of elongate matrix-ingress passages in said braided preform, and (c) impregnating the braided preform with a matrix material, including supplying the matrix material through said passages.

2. The method of claim 1 wherein the fugative fibers comprise fugative braider fibers braided with the non-fugative braider fibers.

3. The method of claim 2 wherein the fugative braider fibers comprise fugative monofilaments braided with the non-fugative fibers.

4. The method of claim 1 wherein the fugative fibers comprise fugative stuffer fibers about which the non-fugative braider fibers are braided.

5. The method of claim 4 wherein the fugative stuffer fibers comprise fugative stuffer monofilaments about which the non-fugative fibers are braided.

6. The method of claim 1 wherein the fugative fibers are removed in step (b) by pulling the fugative fibers out of said braided preform.

7. The method of claim 1 wherein the fugative fibers are removed in step (b) by selectively disintegrating the fugative fibers in said braided preform.

8. The method of claim 7 wherein the fugative fibers are thermally disintegrated.

9. The method of claim 1 wherein the braided preform is impregnated with a resin solution.

10. The method of claim 9 wherein the resin solution includes particles dispersed therein.

11. A method of making a composite article, comprising:

(a) intertwining a plurality of non- fugative braider fibers and a plurality of fugative braider monofilaments to form a braided preform, (b) removing the fugative braider monofilaments from the preform, and (c) impregnating the preform with a matrix material.

12. The method of claim 11 wherein the size of the fugative braider monofilaments is selected to increase the spacing between said nonfugative braider fibers and thereby expand a dimension of the preform.

13. The method of claim 12 wherein the size and position of the fugative braider monofilaments are controlled to increase the width and thickness of the braided preform.

14. The method of claim 12 wherein the size and position of the fugative monofilaments are controlled to vary the shape of the braided preform from one location to another.

15. A method of making an article, comprising:

(a) intertwining a plurality of nonfugative braider fibers about a plurality of fugative stuffer monofilaments to form a braided preform, (b) removing the fugative stuffer monofilaments from the preform, and (c) impregnating the preform with a matrix material.

16. The method of claim 15 further including in step (a) intertwining said non-fugative braider fibers about a plurality of non-fugative stuffer fibers.

17. The method of claim 16 wherein the fugative stuffer monofilaments reduce bending of the non-fugative stuffer fibers by the non-fugative braider fibers.

18. The method of claim 17 wherein the size of the fugative monofilaments is selected to increase the spacing between said non-fugative braider fibers and thereby expand a dimension of the preform.

19. The method of claim 18 wherein the size and position of the fugative monofilaments are controlled to increase the width and thickness of the braided preform.

20. The method of claim 18 wherein the size and position of the fugative monofilaments are controlled to vary the shape of the braided preform from one location to another.

* * * * *

UNITED STATES PATENT AND TRADEMARK OFFICE

CERTIFICATE OF CORRECTION

PATENT NO. : 4,885,973

DATED : December 12, 1989

INVENTOR(S) : Raymond G. Spain

It is certified that error appears in the above-identified patent and that said Letters Patent is hereby corrected as shown below:

Column 2, line 58, after "FIG." insert --1--.
Column 3, line 45, after "bundles" delete ", and".
Column 3, line 56, delete "12,14".
Column 5, line 51, after "10'" insert --.--.

Signed and Sealed this

Sixteenth Day of June, 1992

*Attest:*

DOUGLAS B. COMER

*Attesting Officer*

*Acting Commissioner of Patents and Trademarks*